US010207903B2

(12) United States Patent
Jamieson

(10) Patent No.: US 10,207,903 B2
(45) Date of Patent: Feb. 19, 2019

(54) APPARATUS AND METHOD FOR CONTROLLING THE ORIENTATION OF A SUSPENDED LOAD

(71) Applicant: Torquer Limited, Inverness (GB)

(72) Inventor: Angus Jamieson, Highland (GB)

(73) Assignee: Torquer Limited, Inverness (GB)

( * ) Notice: Subject to any disclaimer, the term of this patent is extended or adjusted under 35 U.S.C. 154(b) by 465 days.

(21) Appl. No.: 15/031,007

(22) PCT Filed: Oct. 24, 2014

(86) PCT No.: PCT/GB2014/053185
§ 371 (c)(1),
(2) Date: Apr. 21, 2016

(87) PCT Pub. No.: WO2015/059498
PCT Pub. Date: Apr. 30, 2015

(65) Prior Publication Data

US 2016/0257533 A1 Sep. 8, 2016

(30) Foreign Application Priority Data

Oct. 24, 2013 (GB) ..... 1318843.8

(51) Int. Cl.
*B66C 1/10* (2006.01)
*B66C 13/06* (2006.01)
*B66C 13/08* (2006.01)

(52) U.S. Cl.
CPC ..... *B66C 13/085* (2013.01); *B66C 1/10* (2013.01); *B66C 13/063* (2013.01)

(58) Field of Classification Search
CPC ..... B66C 1/10; B66C 13/063; B66C 13/085
See application file for complete search history.

(56) References Cited

U.S. PATENT DOCUMENTS

| | | | | |
|---|---|---|---|---|
| 2,856,142 | A | 10/1958 | Haviland | |
| 2,952,235 | A | 9/1960 | Salomon | |
| 5,026,008 | A | 6/1991 | Lurie et al. | |
| 5,871,249 | A | 2/1999 | Williams | |
| 8,857,635 | B2 * | 10/2014 | Weckbecker | B66C 13/28 212/284 |
| 2013/0098012 | A1 * | 4/2013 | Opdenbosch | F15B 1/024 60/327 |
| 2017/0198731 | A1 * | 7/2017 | Sugano | F15B 21/14 |

FOREIGN PATENT DOCUMENTS

| | | | | |
|---|---|---|---|---|
| EP | 0841295 | A2 * | 5/1998 | B66C 13/063 |
| GB | 1179943 | | 2/1970 | |
| WO | WO-2014076189 | A1 * | 5/2014 | B66C 13/04 |

* cited by examiner

*Primary Examiner* — Jennifer L Norton
(74) *Attorney, Agent, or Firm* — Workman Nydegger

(57) ABSTRACT

The invention provides an apparatus [10] and method for controlling the orientation of a suspended load. The apparatus consists of a closed loop pipe [11] containing a fluid volume attachable to a suspended load and at least one pump for circulating the fluid volume in the pipe. A control unit [17] is operable to receive at least one input direction signal. The apparatus includes a control unit which is configured to generate a control signal to activate the at least one pump to control the flow of the fluid volume in the pipe and thereby impart a rotational force on the pipe.

62 Claims, 7 Drawing Sheets

APPARATUS AND METHOD FOR CONTROLLING THE ORIENTATION OF A SUSPENDED LOAD

CROSS-REFERENCE TO RELATED APPLICATIONS

The present invention is a 35 U.S.C. § 371 U.S. National Stage of International Application No. PCT/GB2014/053185, filed on Oct. 24, 2014, which claims priority to Great Britain Patent Application No. 1318843.8, filed Oct. 24, 2013 the entire content of each of which is incorporated herein by reference.

The present invention relates to load position systems and in particular an apparatus and method for controlling the orientation of a suspended load.

BACKGROUND TO THE INVENTION

Loads can be suspended by forklifts, wheel loader overhead cranes such as boom and jib cranes and many other machines that can lift a load higher than ground level. When a load is suspended external forces such as wind can cause the load to rotate about its coupling, changing the orientation of the load relative to its original position. This can be problematic for crane operators trying to maintain a stable position of the load whilst it is suspended. Crane operators also have little or no control to manoeuvre the overhanging load and accurately position the load in desired orientation before it is lowered.

Current load positioning systems involve one or more guide ropes being attached to the suspended load and workers manually dragging the load via the guide ropes into a desired position. This handling operation can be problematic due to miscommunications between workers and external forces such as inclement weather. Such issues can result in collision of the load with obstacles leading to damage of the load and/or the obstacles.

Due to the complexity of the handling operation and the safety protocols for the on-site workers the routes for the suspended loads must be pre-planned to ensure that at no point a worker is required to work directly below the suspended load. This can impose restrictive working conditions when the area to manoeuvre the load is small.

There is a high risk of serious injury or death if a suspended load should fall during handling operations. Due to the nature of the use of guide ropes, the workers are required to be in close proximity of the load and are therefore at an increased risk of danger. The level of danger increases as the weight and size of the load increases. In an effort to overcome these problems load positioning systems have been developed.

JP7252087A discloses a system of rotating a suspended load using precessional effect produced by two gyroscopic counter-rotating wheels. An assembly containing the counter-rotating wheels is attached to the suspended load and a control unit controls the rotation speed and tilt degree of each wheel to induce a precessional force on the assembly and attached load. A disadvantage of this system is that the wheels can only be inclined a limited amount and therefore the precessional force applied to the load is limited.

U.S. Pat. No. 5,871,249 discloses a system for a suspended payload. The system consists of a stabiliser, control and positioner units suspended from a crane and a payload directly coupled under the positioner unit. The stabilising unit creates gyroscopic stability for a suspended load using counter-rotating flywheels in the x, y and z axes and a gear system to rotate the wheels in different directions from a single motor. The counter-rotating flywheels cancel out precessional forces in response to yaw, roll or pitch disturbances.

This system has a very complex assembly with multiple moving parts, seven flywheels rotating at high speeds and an elaborate gearing system. This assembly is required to be attached and detached to each load which involves significant manhandling. If there is any misalignment of the components of the assembly or failure of one element of the system it reduces the operation of the system or could cause the entire system to fail. Another disadvantage of this system is that high speeds of the counter-rotating flywheels and the precession forces applied to the components of the assembly can cause wear to the assembly components. The assembly components would require regular maintenance and replacement parts resulting in maintenance costs and reduces the efficiency of the system.

GB 1179943 discloses a load positioning device composed of counter rotating masses which produce a turning torque on the load. Brakes cooperate with each of the masses in order to rotate the load in one direction by braking one of the rotating masses. To stop the rotation of the load the other brake is applied to the other mass. A disadvantage of this system is that continuous high speeds of the counter-rotating masses and the precession forces applied to the components of the device can cause wear to the device components. The device components such as the braking mechanism would require regular maintenance and replacement parts resulting in high maintenance costs and reduces the efficiency of the system.

Another load positioning system is disclosed in RU 2343102. The positioning system provides for turning a crane hook using flywheels in the lifting mechanism connected to a high torque motor to turn the load relative to the lifting mechanism. A disadvantage of turning the load using this system is that it would result in the lifting lines being twisted and therefore making the load unstable.

A disadvantage of prior art systems that form part of the lifting gear is that the positioning apparatus is exposed to high mechanical stresses when a heavy load is lifted. The apparatus needs to undergo strict testing to meet safety regulations and may be unable to be used for weights over a certain limit.

A problem of prior art systems that use high speed rotating masses or flywheels is that they can cause injuries due to contact with the rotating parts and in the event of a failure the rotating masses/flywheels and other components of the system may become high speed projectiles that could strike and injure workers.

It is the object of the present invention to obviate or at least mitigate the foregoing disadvantages of prior art load positioning systems.

It is another object of an aspect of the present invention to obviate the inaccurate positioning of a load and allow the crane operator to maintain full control of the orientation of the load.

A further object of the invention is to reduce the risk of injury to on-site workers who work in close proximity to the load positioning apparatus. Further aims of the invention will become apparent from the following description.

SUMMARY OF THE INVENTION

According to a first aspect of the invention, there is provided an apparatus for controlling the orientation of a suspended load comprising:

a closed loop pipe containing a fluid volume attachable to a suspended load;

at least one pump for circulating the fluid volume in the pipe; and a control unit operable to receive at least one input direction signal;

wherein the control unit is configured to generate a control signal to activate the at least one pump to control the flow of the fluid volume in the pipe and thereby impart a rotational force on the pipe.

The above-described apparatus may facilitate the accurate positioning of suspended loads by controlling the rotation of the pipe and attached load until the desired orientation has been reached. This apparatus may allow the user to maintain full control of the orientation of the load without the need of workers to manually position the load using guide ropes.

The apparatus may also prevent injuries to workers as positioning of the load can be controlled and effected remotely. In the event of damage or failure of an element of the apparatus it would not result in serious damage and/or injuries as there are no solid high speed rotating elements that can inflict harm.

The input direction signal may be generated by a manual control system. Alternatively, the input direction signal may be generated by at least one directional sensor. The at least one directional sensor may include a compass, gyroscope, accelerometer, attitude indicator or yaw rate sensor.

In one embodiment the input direction signal is generated by a user manually operating variable positional controls indicating the desired orientation that the load should be positioned. The user may manoeuvre the positional controls in the desired direction. The positional controls may generate a direction signal that is communicated to the control unit. The control unit may receive the direction signal and controls the flow of the fluid volume in the closed loop pipe attached to the load based on the direction signal.

Preferably the operating variable positional controls comprise one or more joysticks.

Preferably, the control unit may be set with a desired heading angle for the orientation of the load.

Further preferably, the control unit may be set with a desired heading change for the orientation of the load.

In one embodiment the direction signal is generated by a directional sensor. A desired heading angle for the orientation of the load may be entered into the control unit. The directional sensor may determine the current heading angle and/or the current rotational speed of the load and communicate these to the control unit. The control unit may then determine the effect on these parameters of an applied torque and may determine the torque and/or time required to reach the desired heading, which may include the reverse torque required to bring it to rest at the desired orientation.

The directional sensor may be a compass sensor. The compass sensor may determine the current heading angle of the load and may communicate the current heading angle of the load to the control unit. The control unit may compare the current heading angle of the load with the desired heading angle of the load in the control unit and may generate a control signal to control the flow of the fluid volume in the pipe attached to the load to rotate the load until the desired heading angle is reached.

The directional sensor may be a gyroscopic sensor. The gyroscopic sensor may determine the current heading angle of the load and communicates the current heading angle of the load to the control unit. The starting rotational speed of the load may be measured by one or more gyroscopic sensors and communicated to the control unit.

The control unit may generate a control signal to control the flow of the fluid volume in the pipe attached to the load to rotate the load until the desired heading angle is reached. The gyroscopic sensors may communicate the rotational speed of the load to the control unit. The control unit may calculate the duration of time required to circulate the fluid volume to rotate the load to the desired heading.

The at least one pump may be a fluid pump, impeller or thruster. Preferably, the at least one pump is positioned within the closed loop pipe. The at least one pump may be fixed within the closed loop pipe in a flanged section. The at least one pump may be a reversible pump.

More preferably the at least one pump is battery powered.

The closed loop pipe may be oriented substantially in a plane. Preferably the closed loop pipe is oriented in a substantially horizontal plane in use.

The cross-section of the closed loop pipe may be substantially circular, arch-shaped, elliptical, oval, semi-circular, polygonal such as triangular, square, rectangular, pentagonal, hexagonal and trapezoidal. Preferably the cross-section of the closed loop pipe is circular.

Preferably the cross-section of the pipe is uniform along its length.

The closed loop may be described in a shape in a plane in which it is oriented. The shape may be substantially circular, elliptical, oval, torus or polygon such as triangular, square, rectangular, pentagonal, hexagonal. Preferably the shape of the closed loop is oval having two long parallel sides with semi-circular ends.

Preferably, the pipe is made from a durable material capable of withstanding high pressures. More preferably the material is metal, plastic or fibre composites.

The dimensions of the closed loop pipe may vary depending on the dimensions of the suspended load. Preferably the shape described by the closed loop has a minimum dimension in the plane of approximately 0.25 m More preferably the shape described by the closed loop may have a dimension in the plane which are in the range of 0.25 m to 5 m.

The shape described by the closed loop may have dimensions in the plane which are in the range of 1 m to 5 m in a first direction, and in the range of 0.25 m to 2 m in a second direction perpendicular to the first direction.

The shape described by the closed loop may have dimensions in the plane which are in the range of 2 m to 3 m in a first direction, and in the range of 0.5 m to 1 m in a second direction perpendicular to the first direction The cross-sectional diameter of the closed loop pipe may vary depending on the dimensions of the suspended load. Preferably the cross-sectional diameter of the pipe is between 50 to 500 mm. More preferably the cross-sectional diameter of the pipe is 150 mm.

The fluid may comprise any liquid. Preferably the fluid comprises water. More preferably where there is a risk of freezing, the fluid comprises a mixture of water and an antifreeze agent such as ethylene glycol.

The fluid may comprise additives which increase the density, weight and/or viscosity of the fluid. The fluid may comprise weighting material such as barite, hematite and/or calcium carbonate.

Gelling agents may be added to the fluid to increase the viscosity of the liquid and to facilitate the suspension of additive material in the fluid without settlement.

The apparatus may further comprise a solid mass configured to move and/or circulate in the closed loop pipe. The solid mass may be moved and/or circulated by forces acting on the solid mass by the circulating fluid volume. The solid mass may be made of a dense material such as metal.

The solid mass may comprise at least one drive fin configured to be pushed by the circulating flow of fluid. Preferably, the drive fin is rigid.

Preferably the drive fin is mounted on the upper surface of the solid mass.

The at least one drive fin may be arranged so that it is in the path of the flow of fluid. The at least one drive fin may be arranged in a substantially vertical position.

The solid mass may be mounted on a bearing assembly in the pipe. The solid mass may be composed of a single unit or multiple modular units.

The solid mass may be oriented substantially in a plane. Preferably the solid mass is oriented in a substantially horizontal plane in use.

The solid mass may be described in a shape in a plane in which it is oriented. The shape may be substantially circular, elliptical, oval, torus or polygon such as triangular, square, rectangular, pentagonal, hexagonal. The shape of the solid mass may be the same as the shape of the closed loop pipe.

The cross-section of the solid mass may be substantially circular, arch-shaped, elliptical, oval, semi-circular, polygonal such as triangular, square, rectangular, pentagonal, hexagonal and trapezoidal. The cross-section of the solid mass may be the same shape as the lower half of the cross-section of the closed loop pipe.

Preferably the cross-section of the solid mass is uniform along its length.

The shape and size of the solid mass and/or the bearing assembly may be dimensioned such that the solid mass and/or components of the bearing assembly are able to move and/or circulate within the closed loop pipe.

The shape and size of the solid mass and/or at least one drive fin may be dimensioned such that the at least one drive fin on the solid mass is positioned in the path of the flow of water.

Any reference to the term fin includes any formation configured to react to a flow of fluid including sail, blade, plate, paddle and/or vane.

The pipe may comprise at least one connector for coupling the closed loop pipe to the load. Preferably the pipe has at least one lug allowing the pipe to be tied to the load. The pipe may comprise at least one sealable liquid inlet. The inlets may be permanently or reversibly sealed. Preferably the pipe has four inlets at equal spacing around the diameter of the pipe that are reversibly sealed. More preferably the inlets are reversibly sealed with plug screws.

According to a second aspect of the invention, there is provided a method of controlling the orientation of a suspended load, the method comprising:

providing an apparatus attached to a suspended load, the apparatus comprising a closed loop pipe containing a fluid volume and at least one pump for circulating the fluid volume in the pipe;

generating a direction signal to the control unit to control the flow of the fluid volume in the pipe to impart a rotational force on the apparatus.

The above-described method may facilitate the accurate positioning of suspended loads by using a control unit to communicate with the load position apparatus to control the rotation of the load until a desired orientation has been reached.

This method may also prevent injuries to workers as positioning of the load can be controlled and effected remotely using the control unit and the load positioning apparatus. Workers do not need to use guide ropes or work in close proximity to the load positioning apparatus. Therefore, in the event of damage or failure of an element of the method or apparatus there are no workers in close proximity that would be affected.

In a preferred embodiment the direction signal is generated by a user manually. The method may comprise the user manually operating variable positional controls indicating the desired orientation that the load should be positioned. The method may comprise manoeuvring the positional controls in the desired direction. The positional controls may generate a direction signal that is communicated to the control unit. The control unit may receive the direction signal and may generate a corresponding control signal to control the flow of the fluid volume in the closed loop pipe attached to the load based on the direction signal.

Preferably the operating variable positional controls comprise one or more joysticks.

The fluid volume may be any liquid. Preferably the fluid volume is water. More preferably where there is a risk of freezing, a mixture of water and an antifreeze agent such as ethylene glycol.

The method may comprise setting a rotational angle for the load.

The method may comprise setting a desired heading angle for the load.

The method may comprise determining a current heading angle of the load and communicating the current heading angle of the load to the control unit.

The method may comprise comparing the current heading angle of the load with the desired heading angle of the load in the control unit.

The method may comprise measuring a current rotational speed of the apparatus.

The method may comprise measuring the rotational acceleration of the apparatus.

The method may comprise calculating the duration of time required to rotate the load to a desired heading based on the current heading angle, desired heading angle, current rotational speed of the apparatus and rotational acceleration of the apparatus The method may comprise generating a flow of fluid volume in the pipe to control the movement and/or circulation of a solid mass in the pipe.

The method may comprise circulating the solid mass in the same plane and/or direction as the flow of fluid volume in the pipe.

Embodiments of the second aspect of the invention may include one or more features of the first aspect of the invention or its embodiments, or vice versa.

According to a third aspect of the invention, there is provided a method of controlling the orientation of a suspended load, the method comprising:

providing an apparatus attached to a suspended load, the apparatus comprising a closed loop pipe containing a fluid volume and at least one pump for circulating the fluid volume in the pipe:

setting a rotational angle for the load;

generating a signal from the control unit to control the flow of the fluid volume in the pipe attached to the load to rotate the apparatus through the set rotational angle.

The above-described method may facilitate the accurate positioning of a suspended load. The user does not have to manually judge the orientation position. The method provides that a rotation angle may be entered in the control unit and the load is rotated until the load has been rotated through the set rotational angle.

The above-described method allows a rotation angle to be set to control the angle that that the apparatus sweeps. By varying the rotational angle setting the angle the apparatus sweeps through varies accordingly.

Embodiments of the third aspect of the invention may include one or more features of the first or second aspect of the invention or its embodiments, or vice versa.

According to a fourth aspect of the invention, there is provided a method of controlling the orientation of a suspended load, the method comprising:

providing an apparatus attached to a suspended load, the apparatus comprising a closed loop pipe containing a fluid volume and at least one pump for circulating the fluid volume in the pipe;

setting a desired heading angle for the load; and generating a signal from the control unit to control the flow of the fluid volume in the pipe attached to the load to rotate the pipe and attached load until the desired heading angle is reached.

The method may comprise determining the current heading angle of the load and communicating the current heading angle of the load to the control unit.

The method may comprise comparing the current heading angle of the load with the desired heading angle of the load in the control unit.

The above-described method may facilitate the accurate positioning of a suspended load. The user does not have to manually judge the orientation position. The method provides that a desired heading is entered in the control unit and the load is rotated until the desired heading has been reached.

The method may comprise determining the heading angle using a compass sensor.

In a preferred embodiment the method may comprise setting a control unit with a desired heading angle for the orientation of the load. Measuring the current heading angle of the load may comprise using a compass sensor and communicating the measured heading angle to the control unit. The control unit may compare the current heading angle of the load with the desired heading angle of the load in the control unit and may generate a control signal to control the flow of the fluid volume in the pipe attached to the load to rotate the load until the desired heading angle is reached.

The method may comprise the control unit generating a signal to circulate the fluid volume in the pipe in the opposing direction to the direction of rotation of the pipe to stop or reduce the speed of rotation of the pipe.

The fluid volume may be any liquid. Preferably the fluid volume is water. More preferably where there is a risk of freezing, a mixture of water and an antifreeze agent such as ethylene glycol.

Embodiments of the fourth aspect of the invention may include one or more features of the first, second or third aspects of the invention or its embodiments, or vice versa.

According to a fifth aspect of the invention, there is provided a method for controlling the orientation of a suspended load, the method comprising:

providing an apparatus attached to a suspended load, the apparatus comprising a closed loop pipe containing a fluid volume and at least one pump for circulating the fluid volume in the pipe:

measuring the current heading angle; and generating a signal from a control unit to control the flow of the fluid volume in the pipe to rotate the apparatus until the desired heading angle is reached.

The method may comprise measuring the current rotational speed of the apparatus.

The method may comprise measuring the rotational acceleration of the apparatus.

The method may comprise calculating the duration of time required to rotate the load to a desired heading based on the current heading angle, desired heading angle, current rotational speed of the apparatus and rotational acceleration of the apparatus.

The method may comprise the control unit generating a signal from the control unit to circulate the fluid volume in the pipe in the opposing direction to the direction of rotation of the pipe to stop or reduce the speed of rotation of the pipe.

The above-described method may facilitate the accurate positioning of a suspended load. The user does not have to judge the rotation speed or yaw rate of the load or when to apply the opposite force in order to accurately position the load in the correct orientation. The control unit performs this calculation based on the current heading position and rotational speed of the load and the desired heading position.

Preferably the speed of rotation of the load is monitored. More preferably the speed of rotation of the load is monitored by a gyroscope, a compass or an accelerometer.

In a preferred embodiment the method may comprise setting a control unit with a desired heading angle for the orientation of the load. The current heading angle of the load may be measured using a compass sensor and the current rotational speed of the load may be measured using a gyroscopic sensor. The current heading angle and rotational speed may be communicated to the control unit. The control unit may generate a control signal to control the flow of the fluid volume in the pipe attached to the load to rotate the load. One or more gyroscopic sensors may monitor and communicate the rotational acceleration of the load to the control unit. The control unit may calculate the duration of time required to circulate the fluid volume to rotate the load to the desired heading.

Embodiments of the fifth aspect of the invention may include one or more features of any of the first to fourth aspects of the invention or its embodiments, or vice versa.

According to a sixth aspect of the invention, there is provided an apparatus for controlling the orientation of a suspended load comprising:

a closed loop pipe containing a fluid volume attachable to a suspended load;

at least one pump for circulating the fluid volume in the pipe;

a control unit operable to receive at least one input direction signal; and a solid mass configured to move within the pipe;

wherein the control unit is configured to generate a control signal to activate the at least one pump to control the flow of the fluid volume and movement of the solid mass in the pipe and thereby impart a rotational force on the pipe.

The above-described apparatus may facilitate the accurate positioning of suspended heavy loads by controlling the circulation of the fluid volume and solid mass in the pipe and thereby controlling the rotational force acting on the pipe and attached load.

The input direction signal may be generated by a manual control system. Alternatively, the input direction signal may be generated by at least one directional sensor. The at least one directional sensor may include a compass, gyroscope, accelerometer, attitude indicator or yaw rate sensor.

The cross-section of the closed loop pipe may be substantially circular, arch-shaped, elliptical, oval, semi-circular, polygonal such as triangular, square, rectangular, pentagonal, hexagonal and trapezoidal. Preferably the cross-section of the closed loop pipe is substantially arch-shaped.

Preferably the cross-section of the pipe is uniform along its length.

The closed loop may be described in a shape in a plane in which it is oriented. The shape may be substantially circular, elliptical, oval, torus or polygon such as triangular, square, rectangular, pentagonal, hexagonal. Preferably the shape of the closed loop may be oval having two long parallel sides with semi-circular ends.

The solid mass may be moved and/or circulated in the pipe by forces acting on the solid mass by the circulating fluid volume.

The solid mass may comprise at least one drive fin configured to be pushed by the circulating flow of fluid. Preferably, the drive fin is rigid. The drive fin may be mounted on the upper surface of the solid mass.

Preferably the solid mass is mounted on a bearing assembly in the pipe. The solid mass may be composed of a single unit or multiple modular units.

In one embodiment the solid mass is a solid ring and the shape of the closed loop in a plane in which it is orientated is circular. The solid ring may be made of a dense material such as metal.

Any reference to the term fin includes any formation configured to be pushed or react to a flow of fluid including sail, blade, plate, paddle and/or vane.

Embodiments of the sixth aspect of the invention may include one or more features of any of the first to fifth aspects of the invention or its embodiments, or vice versa.

According to a seventh aspect of the invention, there is provided a method of controlling the orientation of a suspended load, the method comprising:

providing an apparatus attached to a suspended load, the apparatus comprising a closed loop pipe containing a fluid volume, a solid mass and at least one pump for circulating the fluid volume in the pipe;

generating a direction signal to the control unit to control the flow of the fluid volume and direction of movement of the solid mass in the pipe to impart a rotational force on the apparatus.

The method may comprise generating a flow of fluid volume in the pipe to control the direction of movement and/or circulation of the solid mass in the pipe.

Preferably the flow of the fluid volume in the pipe exerts a force on the solid mass which causes it to move and/or circulate in the pipe.

The method may comprise moving the solid mass in the same plane and/or direction as the flow of the fluid volume in the pipe.

Embodiments of the seventh aspect of the invention may include one or more features of any of the first to sixth aspects of the invention or its embodiments, or vice versa.

According to a eighth aspect of the invention, there is provided a spreader bar apparatus, the apparatus comprising the orientation control apparatus according to the first aspect of the invention.

Embodiments of the sixth eighth aspect of the invention may include one or more features of any of the first to seventh aspects of the invention or its embodiments, or vice versa.

According to a ninth aspect of the invention, there is provided a load lifting system for a crane, the load lifting system comprising the positioning control method according to the second aspect of the invention.

Embodiments of the ninth aspect of the invention may include one or more features of any of the first to eighth aspects of the invention or its embodiments, or vice versa.

According to yet further aspects of the invention, there is provided apparatus and methods for controlling the orientation of a suspended load, spreader bar apparatus or a load lifting system for a crane substantially as herein described with reference to the appended drawings.

BRIEF DESCRIPTION OF THE DRAWINGS

There will now be described, by way of example only, an embodiment of the invention with reference to the drawings, of which.

DETAILED DESCRIPTION OF PREFERRED EMBODIMENTS

Figure 1:
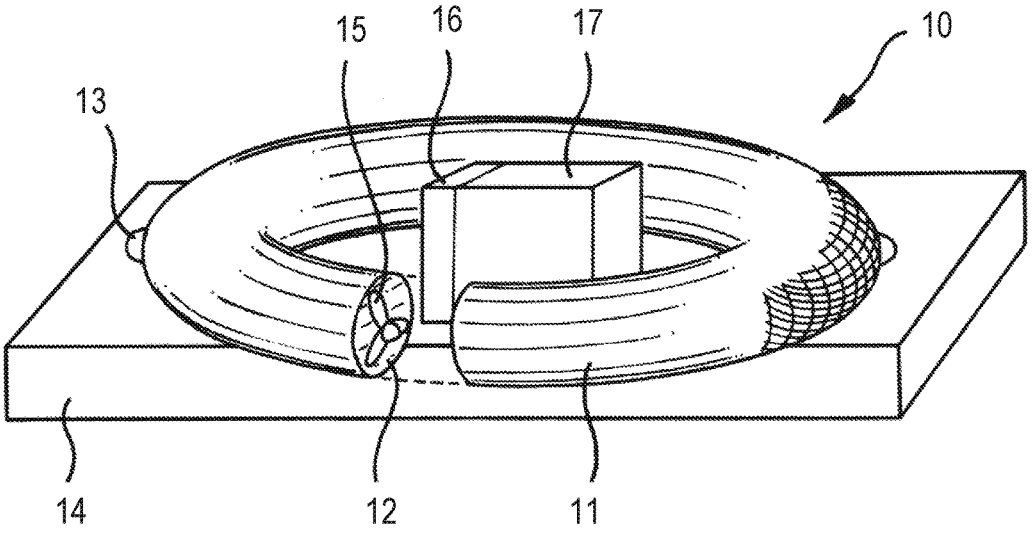
FIG. 1 is a diagram of the apparatus according to a first embodiment of invention.

Referring firstly to FIG. 1, there is shown generally depicted at 10, an orientation control apparatus. A section of the apparatus has been removed to provide a clear description. The apparatus 10 comprises a closed circular loop pipe 11 made of polyethylene, the pipe 11 is filled with water 12. The apparatus 10 is placed on top of a load 14 that is to be suspended from a crane. The pipe 11 has lugs 13 which allow it to be secured to the load 14 by a rope. An impeller 15 is contained within the pipe 11. The impeller 15 is powered by a battery unit 16. The battery unit 16 also provides power to a control unit 17. The control unit 17 controls the direction and speed that the impeller 16 rotates in the pipe.

If the control unit 17 activates the impeller 15 to circulate the water 12 in an anticlockwise direction, the circulating water 12 in the pipe 11 generates a torque on the apparatus 10 and the load 14. The apparatus 10 and the load 14 rotate in a clockwise direction.

If the control unit 17 activates the impeller 15 to circulate the water 12 in a clockwise direction, the circulating water 12 in the pipe generates a torque on the apparatus 10 and the load 14. The apparatus 10 and the load 14 rotate in an anticlockwise direction.

If the control unit 17 deactivates the impeller 15, the impeller 15 does not circulate water 12 in the pipe 11, the decelerating water generates a reverse torque on the apparatus 10 and the load 14 and helps to stop the rotation of the apparatus 10 and the load 14. If necessary, the control unit 17 may activate the impeller 15 to circulate the water in the pipe 11 in the opposing direction to further brake the rotation of the apparatus 10 and the load 14 to bring the apparatus 10 and load 14 to a final rest position.

Figure 2:
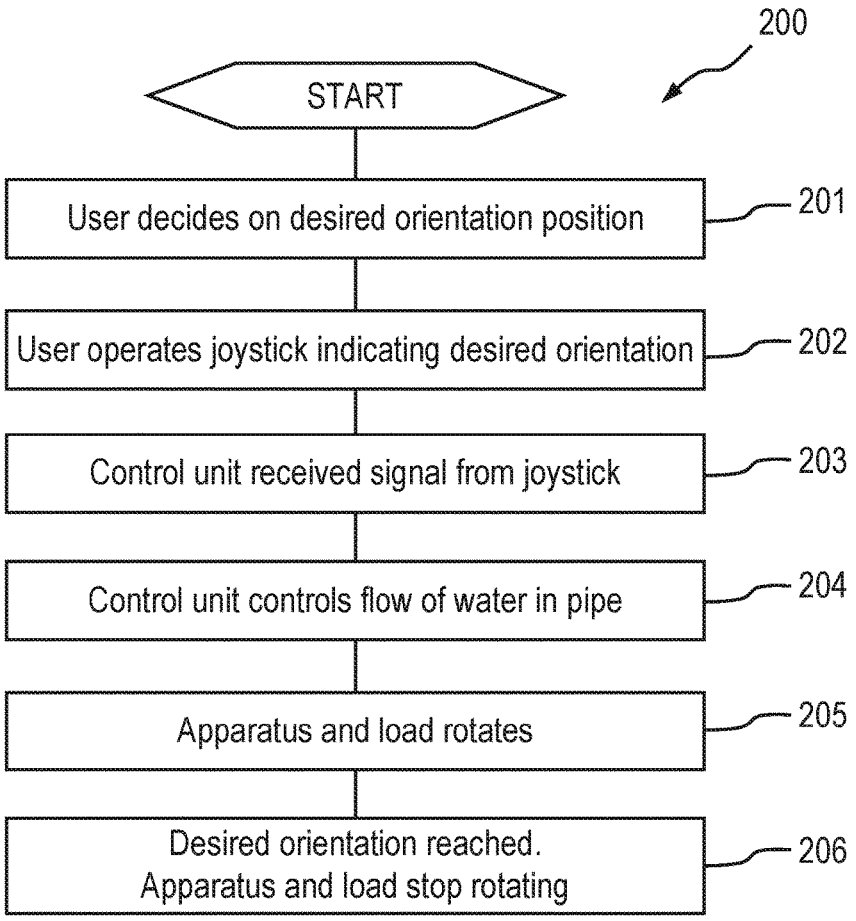
FIG. 2 is a flow diagram of the method according to a first embodiment of invention.

FIG. 2 is a flow diagram representing steps of a method 200 in accordance with the second embodiment. The method starts by a user deciding the desired position of the load (Step 201). The user manually operates a joystick indicating the desired orientation that the load should be positioned (Step 202). The joystick is connected to the control unit and the control unit receives the signal from the joystick (Step 203). The control unit controls the flow of the water in the closed loop pipe attached to the load based on the signal of the desired position (Step 204). The flow of circulating water in the pipe generates a torque on the apparatus and the load and the apparatus and the load rotate in the desired direction (Step 205).

Once the desired orientation of the load has been reached (Step 206) the user moves the joystick to a neutral position. The signal to the control unit is discontinued and the control unit stops the flow of the water in the pipe. The decelerating water generates a reverse torque on the apparatus and the load and helps to stop the rotation of the apparatus and the load. If necessary, the control unit may control the flow of the water in the closed loop pipe in the opposing direction to further brake the rotation to bring the apparatus and load to a final rest position.

Figure 3:
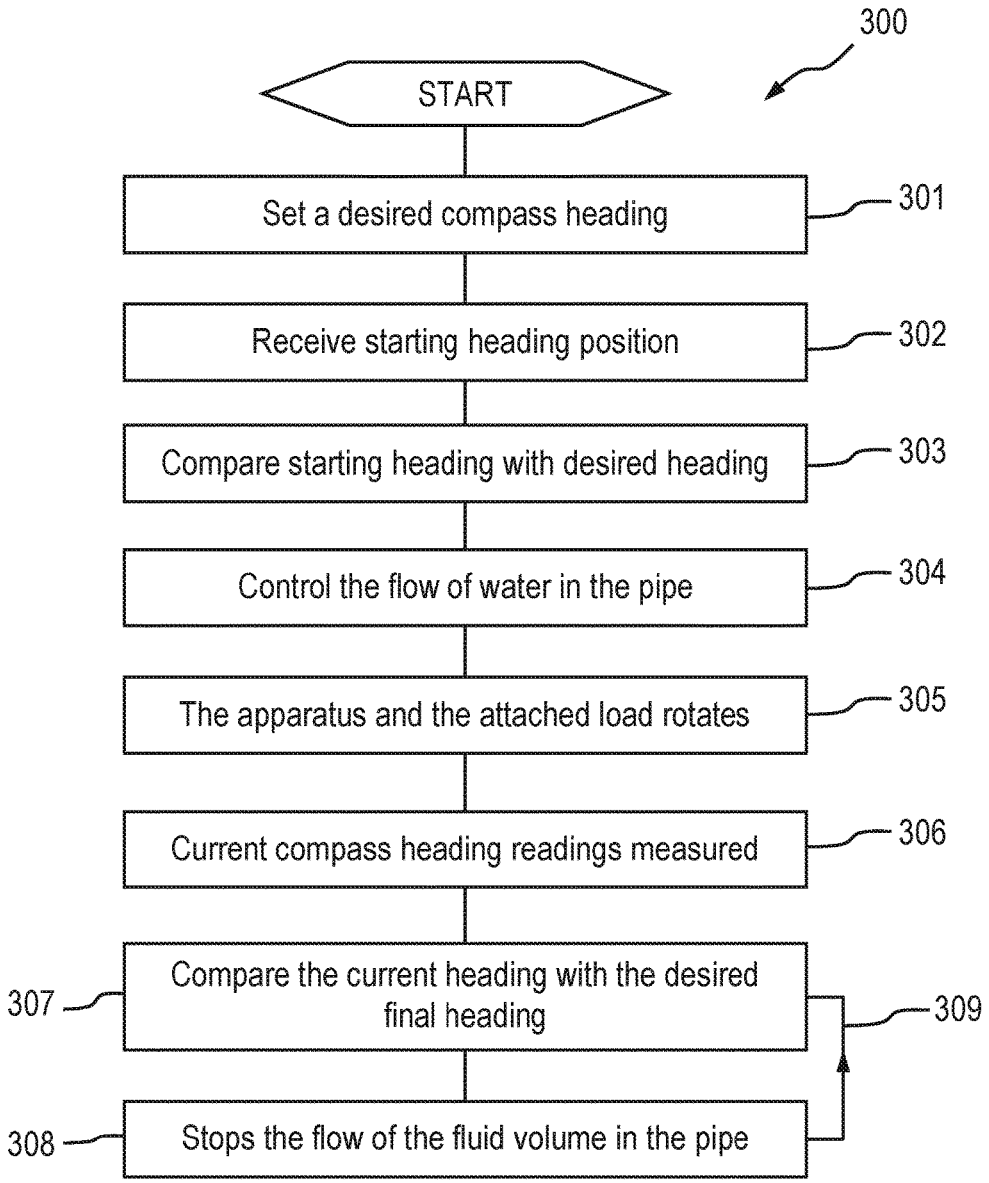
FIG. 3 is a flow diagram of the method according to a second embodiment of invention.

FIG. 3 is a flow diagram representing steps of a method 300 in accordance with the second embodiment. The method starts by setting a desired compass heading in the control unit for the desired final compass heading position of the load (Step 301). The load is intended to be orientated to this position and maintained at this position throughout the suspension of the load.

The control unit receives the measured starting compass heading position of the load by one or more compass sensors (Step 302). The control unit compares the measured starting compass heading position of the load with the desired final compass heading position (Step 303). The control unit controls the flow of water in the closed loop pipe attached to the load (Step 304). The direction of the circulation of water in the pipe and the rate of circulation generate torque on the load and rotate the load in the yaw axis (Step 305).

The current compass heading of the position of the load is measured by one or more compass sensors and communicated to the control unit (Step 306). The control unit compares the measured current compass heading position of the load with the desired final compass heading position (Step 307). Once the real-time compass heading position of the load reaches the desired final compass heading position the control unit stops the flow of water in the closed loop (Step 308). The decelerating water generates a reverse torque on the apparatus and the load and helps to stop the rotation of the apparatus and the load. If necessary, the control unit may control the flow of water in the closed loop pipe in the opposing direction to further brake the rotation to bring the apparatus and load to a final rest position.

The current compass heading of the position of the load continues to be measured and compared with the desired final compass heading position (Step 309). Therefore, if the load is buffeted by an external force the control unit controls the flow of water in the closed loop to return the position of the load to the desired final compass heading position.

Figure 4:
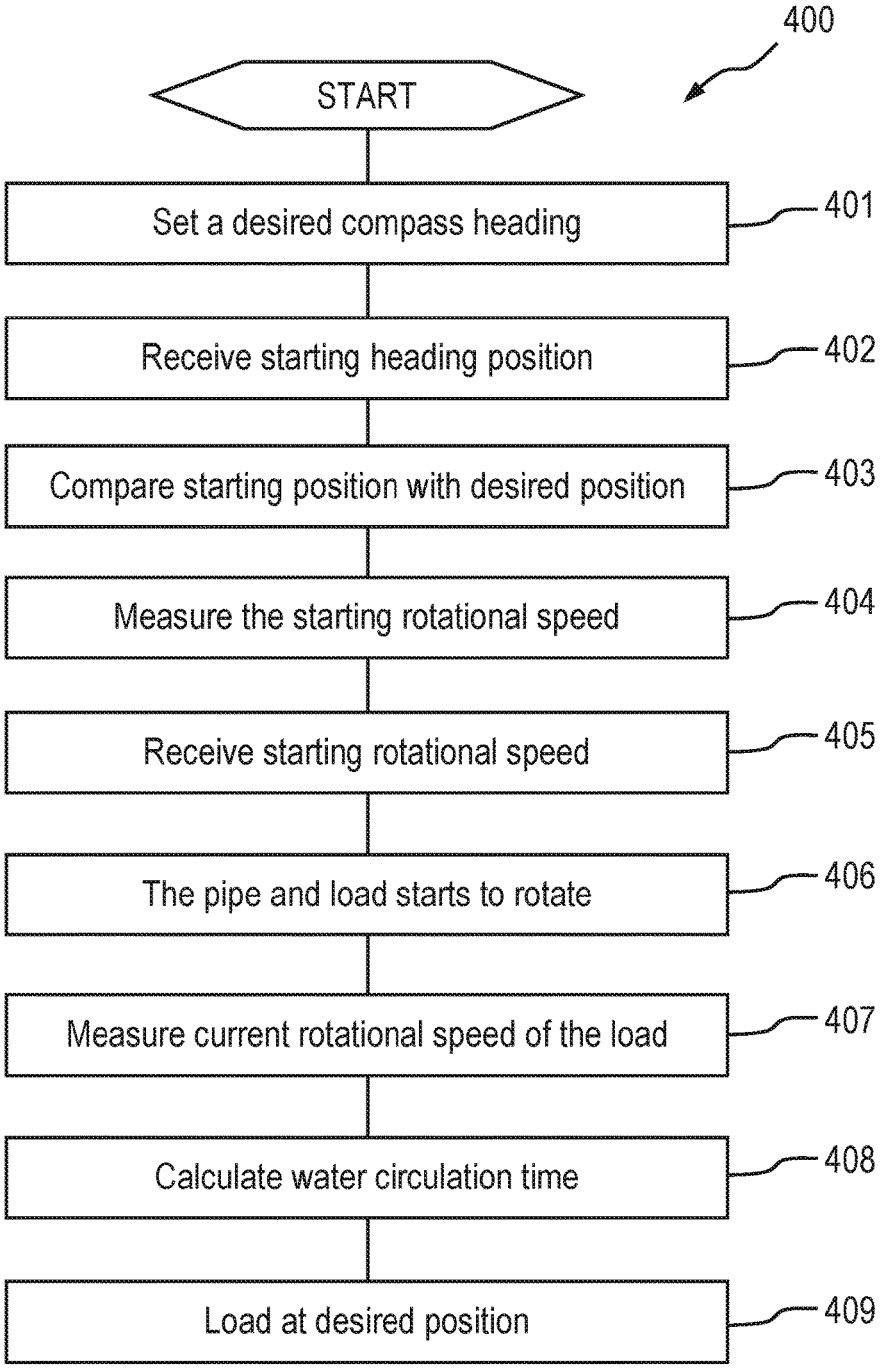
FIG. 4 is a flow diagram of the method according to a third embodiment of invention.

FIG. 4 is a flow diagram representing steps of a method 400 in accordance with the second embodiment. The method starts by setting a desired compass heading in the control unit for the desired final compass heading position of the load (Step 401). The load is intended to be orientated to this position and maintained at this position throughout the suspension of the load.

The control unit receives the measured starting compass heading position of the load by one or more compass sensors (Step 402). The control unit compares the measured starting compass heading position of the load with the desired final compass heading position (Step 403). The starting rotational speed of the load is measured by one or more gyroscopic sensors (Step 404). The control unit also receives the measured starting rotational speed of the load (Step 405). This initial rotation can be due to external factors such as wind.

The control unit controls the flow of water in the closed loop tube attached to the load. The direction of the circulation of the liquid in the closed loop tube and the rate of circulation generate torque on the load and rotate the load in the yaw axis Step 406).

The current rotational speed of the load is measured by one or more gyroscopic sensors and communicated to the control unit as the load rotates (Step 407).

The control unit calculates the duration of time required to circulate water to rotate the load to the desired heading (Step 408).

The control unit calculation is based on:

$$\text{Rotational acceleration (Ra)} = \text{Change in speed}/\text{change in time}$$

$$\text{Ra} \times \text{Time}^2 + \text{Current Speed} \times \text{Time} = 0.5 \times (\text{Desired final heading} - \text{Current heading})$$

Once the calculated duration of time has elapsed the control unit stops the flow of water in the closed loop with the load positioned in the desired final compass heading position (Step 408). The decelerating water generates a reverse torque on the apparatus and the load and helps to stop the rotation of the apparatus and the load. If necessary, the control unit may control the flow of water in the closed loop pipe in the opposing direction to further brake the rotation to bring the apparatus and load to a final rest position.

Figure 5:
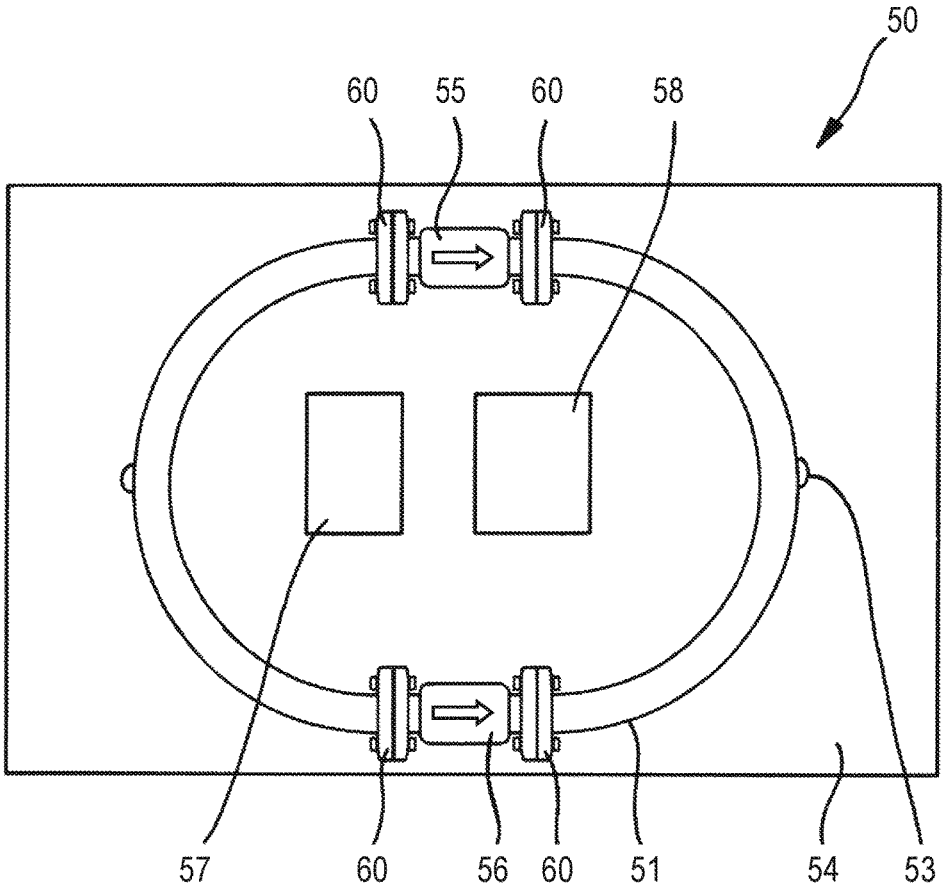
FIG. 5 is an overhead view of a diagram of the apparatus according to a fourth embodiment of invention.

Referring to FIG. 5, there is shown generally depicted at 50, an orientation control apparatus according to an alternative embodiment of the invention. The apparatus 50 comprises a closed circular loop pipe 51 made of polyethylene and which is filled with water (not shown). The apparatus 50 is placed on top of a load 54 that is to be suspended from a crane. The pipe 51 has lugs 53 which allow it to be secured to the load 54 by a rope. The apparatus has two pumps 55 and 56 contained within the pipe 51. The pumps 55 and 56 are arranged to pump water in opposing directions. Pump 55 pumps water in a clockwise direction. Pump 56 is arranged to pump water in an anticlockwise direction. The pumps 55, 56 are fixed within the pipe 51 by flange sections 60. The pumps 55, 56 are powered by a battery unit 57. The battery unit 57 also provides power to a control unit 58. The control unit 58 controls which pump 55 or 56 is activated and the speed that the pump 55 or 56 circulates the water in the pipe.

If the load is to be rotated in an anticlockwise direction, the control unit 58 activates pump 55 to pump water in the pipe 51 in a clockwise direction. The circulating water in the pipe 51 generates a torque on the apparatus 50 and the load 54 and the apparatus 50 and the load 54 rotate in an anticlockwise direction.

If the control unit 58 deactivates the pump 55, the pump 55 stops circulating water in the pipe 51, the decelerating water generates a reverse torque on the apparatus 50 and the load 54 and helps to stop the rotation of the apparatus 50 and the load 54. If necessary, the control unit 58 may activate the pump 56 to circulate the water in the pipe 51 in an anticlockwise direction to further brake the rotation of the apparatus 50 and the load 54 to bring the apparatus 50 and load 54 to a final rest position.

If the load is to be rotated in a clockwise direction, the control unit 58 activates pump 56 to pump water in the pipe 51 in an anticlockwise direction. The circulating water in the pipe generates a torque on the apparatus 50 and the load 54 and the apparatus 50 and the load 54 rotate in a clockwise direction.

If the control unit 58 deactivates the pump 56, the pump 56 stops circulating water in the pipe 51, the decelerating water generates a reverse torque on the apparatus 50 and the load 54 and helps to stop the rotation of the apparatus 50 and the load 54. If necessary, the control unit 58 may activate the pump 55 to circulate the water in the pipe 51 in a clockwise direction to further brake the rotation of the apparatus 50 and the load 54 to bring the apparatus 50 and load 54 to a final rest position.

Figure 6A:
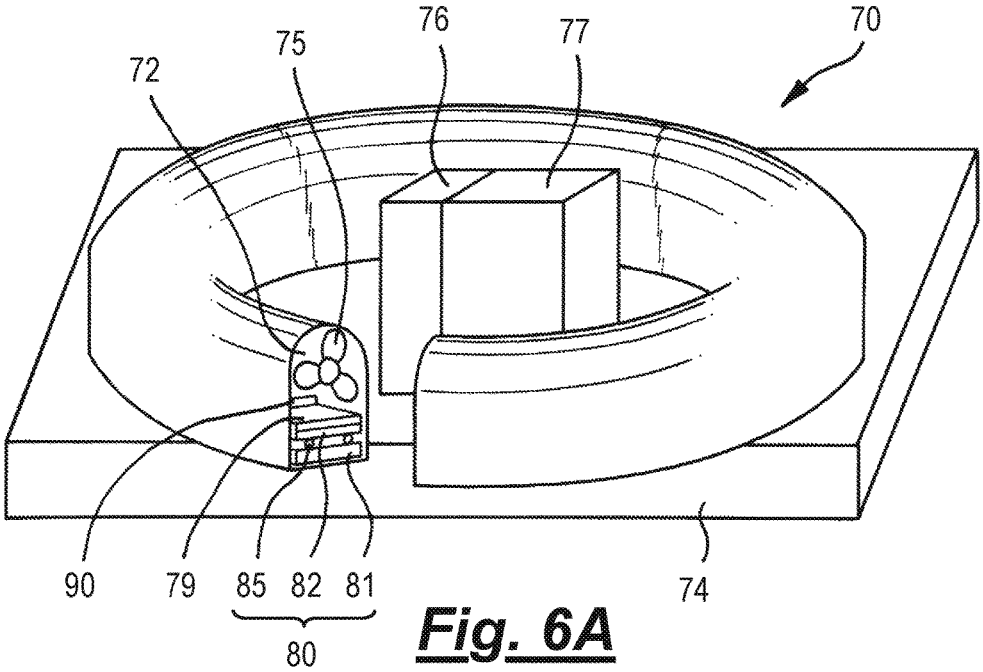
FIG. 6A is a diagram of the apparatus according to a fifth embodiment of invention.
Figure 6B:
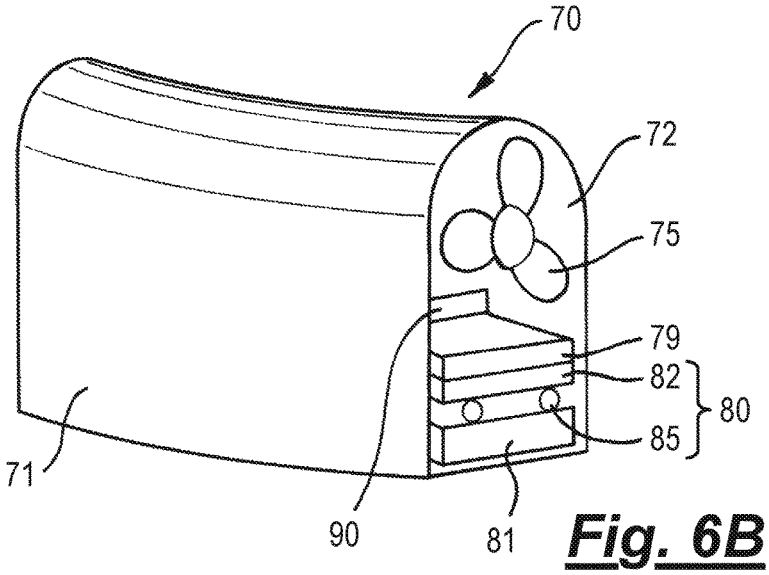
FIG. 6B is a diagram of a section of the apparatus of FIG. 6A, shown in an enlarged view.

Referring to FIGS. 6A and 6B, there is shown generally depicted at 70, an orientation control apparatus according to an alternative embodiment of the invention. A section of the apparatus 70 has been removed for clarity. The apparatus 70 comprises a closed circular loop pipe 71 made of polyethylene, the cross-section of the closed loop pipe is arch-shaped having a substantially flat base with substantial straight sides and a curved arc top section. The curved arc top section is opposite the substantially flat base. The pipe 71 is filled with water 72.

A steel ring 79 is located in the pipe. The steel ring 79 is mounted on an anti-friction bearing assembly 80. The bearing assembly 80 comprises a lower bearing member 81 and an upper bearing member 82. The lower bearing member 81 is fixed to the inner surface of the pipe. The inner face of the lower and upper bearing members 80, 81 comprise grooves (not shown) which define races for circular rows of ball bearings 85. As a result of the ball bearings 85 being located between the lower and upper bearing members, the upper bearing member is moveable relative to the lower bearing member 81. The steel ring 79 is supported by the upper bearing member and may be moved within the pipe relatively friction-free. The steel ring 79 and the bearing assembly 80 are dimensioned such that the steel ring 79 is free to move within the closed loop pipe.

The steel ring 79 has a number of drive fins 90 located on its upper surface. The drive fins 90 are arranged so that a force exerted onto the drive fins 90 by water flow in the pipe causes the steel ring 79 to move along the bearing assembly around the pipe.

The apparatus 70 is placed on top of a load 74 that is to be suspended from a crane. An impeller 75 is contained within the pipe 71. The impeller 75 is capable of rotation in a clockwise and an anticlockwise direction. The impeller 75 is powered by a battery unit 76.

The battery unit 76 also provides power to a control unit 77. The control unit 77 controls the direction and speed that the impeller 75 rotates in the pipe.

If the control unit 77 activates the impeller 75 to circulate the water 72 in a clockwise direction, the force exerted onto the drive fins 90 by the water flow causes the steel ring to move within the pipe in a clockwise direction. The circulating water 72 and steel ring 79 in the pipe 71 generates a torque on the apparatus 70 and the load 74. The apparatus 70 and the load 14 rotate in an anticlockwise direction.

If the control unit 77 activates the impeller 75 to circulate the water 72 in an anticlockwise direction, the force exerted onto the drive fins 90 by the water flow causes the steel ring 79 to move within the pipe in an anticlockwise direction. The circulating water 72 and steel ring 79 in the pipe generate a torque on the apparatus 70 and the load 74. The apparatus 70 and the load 74 rotate in a clockwise direction.

If the control unit 77 deactivates the impeller 75, the impeller 75 does not circulate water 72 in the pipe 71 and the force exerted onto the drive fins 90 is reduced or stopped. The decelerating water generates a reverse torque on the apparatus 70 and the load 74 and helps to stop the rotation of the apparatus 70 and the load 74. If necessary, the control unit 77 may activate the impeller 75 to circulate the water in the pipe 71 in the opposing direction. The water flow in the opposing direction exerts a force onto the drive fins 90 move the steel ring in the opposing direction. The water flow in the opposing direction further brakes the rotation of the apparatus 70 and the load 74 to bring the apparatus 70 and load 74 to a final rest position.

Figure 7A:
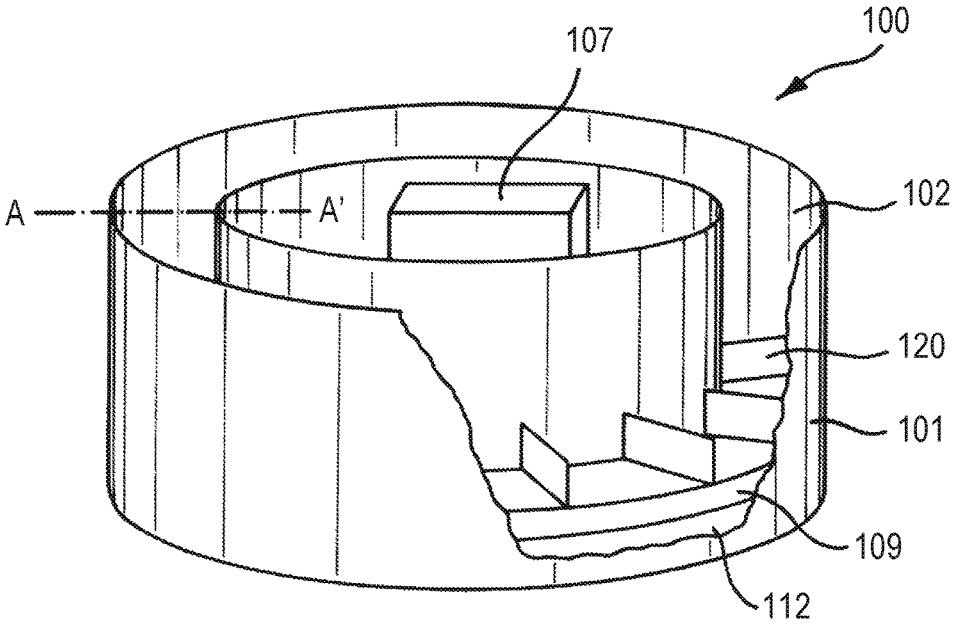
FIG. 7A is a diagram of the apparatus according to a further embodiment of invention.
Figure 7B:
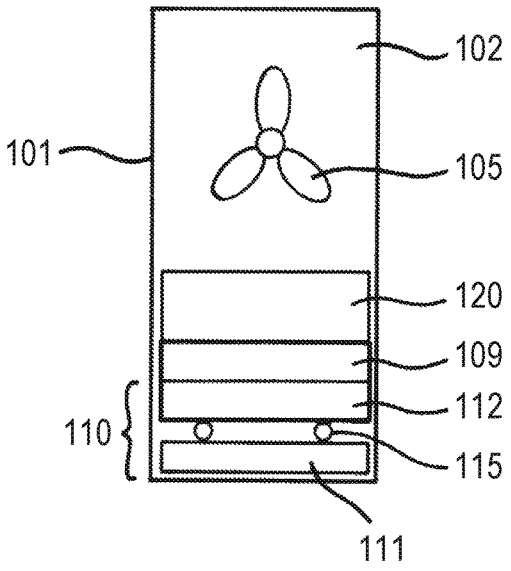
FIG. 7B is a diagram of the apparatus of FIG. 7A, shown in cross-sectional view taken along line A-A' in FIG. 7A.

Referring to FIGS. 7A and 7B, there is shown generally depicted at 100, an orientation control apparatus according to a further embodiment of the invention. The top section and a section of the side of the apparatus 70 has been removed in FIG. 7A for clarity. The apparatus 100 comprises a closed circular loop pipe 101 made of fibreglass, the cross-section of the closed loop pipe is rectangular having a substantially flat base with substantial straight sides and a substantially flat top section. The pipe 101 is filled with water 102.

A steel ring 109 is located in the pipe 101. The steel ring 109 is mounted on an anti-friction bearing assembly 110. The bearing assembly 110 comprises a lower bearing member 111 and an upper bearing member 112. The lower bearing member 111 is fixed to the inner surface of the pipe. The inner face of the lower and upper bearing members comprise grooves (not shown) which define races for circular rows of ball bearings 115. As a result of the ball bearings 115 being located between the lower and upper bearing members 111 and 112, the upper bearing member is moveable relative to the lower bearing member 111. The steel ring 109 is supported by the upper bearing member 112 and may be moved within the pipe relatively friction-free. The steel ring 109 and the bearing assembly 110 are dimensioned such that the steel ring 109 is free to move within the closed loop pipe.

The steel ring 109 has a number of drive fins 120 located on its upper surface. The drive fins 120 are arranged in a substantially vertical position so that they are in the path of the water flow. A circulating water flow in the pipe exerts a force onto the drive fins 120 and causes the steel ring 109 to move along the bearing assembly 110 around the pipe 101.

The apparatus 100 is placed on top of a load (not shown) that is to be suspended from a crane. An impeller 105 is contained within the pipe 101 and is positioned above the drive fins 120 such that water flow from the impeller 105 is exerted on the drive fins 120. The impeller 105 is powered by a battery unit (not shown). The impeller 105 is capable of rotation in a clockwise and an anticlockwise direction. The battery unit also provides power to a control unit (not shown). The control unit controls the direction and speed that the impeller 105 rotates in the pipe.

If the control unit 107 activates the impeller 105 to circulate the water 102 in a clockwise direction, the force exerted onto the drive fins 120 by the water flow causes the steel ring to move within the pipe 101 in a clockwise direction. The circulating water 102 and steel ring 109 in the pipe 101 generate a torque on the apparatus 100 and the load. The apparatus 100 and the load rotate in an anticlockwise direction.

If the control unit 107 activates the impeller 105 to circulate the water 102 in an anticlockwise direction, the force exerted onto the drive fins 120 by the water flow causes the steel ring 109 to move within the pipe 101 in an anticlockwise direction. The circulating water 102 and steel ring 109 in the pipe generate a torque on the apparatus 100 and the load. The apparatus 100 and the load rotate in a clockwise direction.

If the control unit 107 deactivates the impeller 105, the impeller 105 does not circulate water 102 in the pipe 101 and the force exerted onto the drive fins 120 is reduced or stopped. The decelerating water generates a reverse torque on the apparatus 100 and the load and helps to stop the rotation of the apparatus 100 and the load. If necessary, the control unit 107 may activate the impeller 105 to circulate the water in the pipe 101 in the opposing direction. The water flow in the opposing direction exerts a force onto the drive fins 120 move the steel ring in the opposing direction. The water flow in the opposing direction further brakes the rotation of the apparatus 100 and the load to bring the apparatus 100 and load to a final rest position.

Although the described embodiments relate to water as the fluid volume, the present invention may also be applied to other fluids.

In other embodiments of the invention different closed loop shapes may be used.

The described embodiments use compass sensors and gyroscopic sensors. However, the present invention may also be applied to other sensors such as accelerometers, attitude indicators or yaw rate sensors.

The invention provides an apparatus and method for controlling the orientation of a suspended load. The apparatus consists of a closed loop pipe containing a fluid volume attachable to a suspended load and at least one pump for circulating the fluid volume in the pipe. A control unit is operable to receive at least one input direction signal. The apparatus includes a control unit which is configured to generate a control signal to activate the at least one pump to control the flow of the fluid volume in the pipe and thereby impart a rotational force on the pipe The present invention in its various aspects provides an improved apparatus and method for controlling the orientation of a suspended load. It allows the user to maintain full and accurate control of the orientation of the load. The load can be positioned without the apparatus being part of the lifting mechanism and the apparatus is not exposed to mechanical stresses incurred by the weight of the load. Therefore the lifespan of the apparatus is extended and it does not require frequent maintenance or repairs. The apparatus and method is safer than prior art systems which require on-site workers manually positioning the load by guide ropes or working in close proximity to the suspended load. In the event of damage or failure of an element of the apparatus it would result in the fluid volume leaking or being expelled from the pipe which would cause minimal damage and/or injuries The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended.

The invention claimed is:

1. An apparatus for controlling the orientation of a suspended load comprising:

a closed loop pipe containing a fluid volume attachable to a suspended load;

at least one impeller positioned within the closed loop pipe for circulating the fluid volume in the closed loop pipe; and a control unit receives at least one input direction signal;

wherein the control unit generates a control signal to activate the at least one impeller, wherein the at least one activated impeller controls the flow of the fluid volume in the closed loop pipe based on the at least one input direction signal to impart a rotational force on the closed loop pipe.

2. The apparatus as claimed in claim 1 wherein the at least one input direction signal comprises an input direction signal generated by a manual control system.

3. The apparatus as claimed in claim 1 wherein the at least one input direction signal comprises an input direction signal generated by at least one directional sensor.

4. The apparatus as claimed in claim 3 wherein the at least one directional sensor comprises a sensor selected from the group comprising:

a compass, a gyroscope, an accelerometer, an attitude indicator and a yaw rate sensor.

5. The apparatus as claimed in claim 1 wherein the input direction signal is generated by variable positional controls.

6. The apparatus as claimed in claim 5 wherein the variable positional controls comprise one or more joysticks.

7. The apparatus as claimed in claim 3 wherein the at least one directional sensor determines a current heading angle and/or a current rotational speed of the load.

8. The apparatus as claimed in claim 1 wherein the control unit determines a torque and/or time required to reach a desired orientation.

9. The apparatus as claimed in claim 1 wherein the control unit determines a reverse torque required to bring the load to rest at a desired orientation.

10. The apparatus as claimed in claim 1 wherein the apparatus further comprises a solid mass that circulates in the closed loop pipe.

11. The apparatus as claimed in claim 10 wherein the solid mass has at least one drive fin.

12. The apparatus as claimed in claim 11 wherein the at least one drive fin is pushable by the circulating flow of fluid.

13. The apparatus as claimed in claim 10 wherein the solid mass is mounted on a bearing assembly in the closed loop pipe.

14. The apparatus as claimed in claim 3 wherein the at least one directional sensor is a compass sensor.

15. The apparatus as claimed in claim 14 wherein the compass sensor determines a current heading angle of the load.

16. The apparatus as claimed in claim 15 wherein the control unit compares the current heading angle of the load with a desired heading angle of the load in the control unit; and generates a control signal to control the flow of the fluid volume in the closed loop pipe attached to the load to rotate the load until the desired heading angle is reached.

17. The apparatus as claimed in claim 3 wherein the at least one directional sensor is a gyroscopic sensor.

18. The apparatus as claimed in claim 17 wherein the gyroscopic sensor determines current heading angle and/or a current rotational speed of the load.

19. The apparatus as claimed in claim 18 wherein the gyroscopic sensor communicates the current heading angle and/or the rotational speed of the load to the control unit.

20. The apparatus as claimed in claim 1 wherein the at least one impeller is fixed within the closed loop pipe in a flanged section.

21. The apparatus as claimed in claim 1 wherein the at least one impeller is battery powered.

22. The apparatus as claimed in claim 1 wherein the closed loop pipe is oriented substantially in a plane.

23. The apparatus as claimed in claim 22 wherein the closed loop pipe is oriented in a substantially horizontal plane in use.

24. The apparatus as claimed in claim 1 wherein a cross-section of the closed loop pipe is selected from: substantially circular, elliptical, oval, semi-circular or polygonal.

25. The apparatus as claimed in claim 24 wherein the cross-section of the closed loop pipe is circular.

26. The apparatus as claimed in claim 1 wherein a cross-section of the closed loop pipe is uniform along its length.

27. The apparatus as claimed in claim 1 wherein the closed loop is describes a shape in a plane in which it is oriented, the shape being selected from the group comprising:

substantially circular, elliptical, oval, torus or polygonal.

28. The apparatus as claimed in claim 27 wherein the shape of the closed loop is oval having two long parallel sides with semi-circular ends.

29. The apparatus as claimed in claim 1 wherein the closed loop pipe comprises at least one material selected from the group comprising:

metal, plastic or fibre composites.

30. The apparatus as claimed in claim 27 wherein the shape described by the closed loop has a minimum dimension in the plane of approximately 0.25 m.

31. The apparatus as claimed in claim 30 wherein the shape described by the closed loop has a dimension in the plane which are in the range of 0.25 m to 5 m.

32. The apparatus as claimed in claim 31 wherein the shape described by the closed loop has dimensions in the plane which are in the range of 1 m to 5 m in a first direction, and in the range of 0.25 m to 2 m in a second direction perpendicular to the first direction.

33. The apparatus as claimed in claim 32 wherein the shape described by the closed loop has dimensions in the plane which are in the range of 2 m to 3 m in a first direction, and in the range of 0.5 m to 1 m in a second direction perpendicular to the first direction.

34. The apparatus as claimed in claim 1 wherein a cross-sectional diameter of the closed loop pipe is between 50 to 500 mm.

35. The apparatus as claimed in claim 1 wherein a cross-sectional diameter of the closed loop pipe is 150 mm.

36. The apparatus as claimed in claim 1 wherein the fluid volume comprises water.

37. The apparatus as claimed in claim 1 wherein the fluid volume comprises a mixture of water and an antifreeze agent.

38. The apparatus as claimed in claim 1 wherein the closed loop pipe comprises at least one connector for coupling the closed loop pipe to the load.

39. The apparatus as claimed in claim 1 wherein the closed loop pipe comprises at least one sealable liquid inlet.

40. The apparatus as claimed in claim 39 wherein the inlets are permanently or reversibly sealed.

41. A method of controlling the orientation of a suspended load, the method comprising:

providing an apparatus attached to a suspended load, the apparatus comprising a closed loop pipe containing a fluid volume and at least one impeller positioned within the closed loop pipe for circulating the fluid volume in the closed loop pipe;

generating a direction signal by a control unit to control the flow of the fluid volume in the closed loop pipe to impart a rotational force on the apparatus;

activating the at least one impeller using the generated direction signal, wherein the at least one activated impeller controls the flow of the fluid volume in the closed loop pipe, which imparts the rotational force on the apparatus.

42. The method as claimed in claim 41 comprising generating the direction signal manually.

43. The method as claimed in claim 41 comprising operating variable positional controls to indicate the desired orientation of the load.

44. The method as claimed in claim 43 wherein the operating variable positional controls comprise one or more joysticks.

45. The method as claimed in claim 41 comprising setting a rotational angle for the load.

46. The method as claimed in claim 45 comprising entering the rotation angle in the control unit, the apparatus and load is rotated until the apparatus and load have been rotated through the set rotational angle.

47. The method as claimed in claim 41 comprising setting a desired heading angle for the load.

48. The method as claimed in claim 47 comprising generating a signal from the control unit to control the flow of the fluid volume in the closed loop pipe attached to the load to rotate the closed loop pipe and attached load until the desired heading angle is reached.

49. The method as claimed in claim 41 comprising measuring the current heading angle of the load.

50. The method as claimed in claim 49 comprising comparing the current heading angle of the load with the desired heading angle of the load in the control unit.

51. The method as claimed in claim 47 comprising determining the heading angle using a compass sensor.

52. The method as claimed in claim 41 comprising measuring a current rotational speed of the apparatus.

53. The method as claimed in claim 41 comprising measuring a rotational acceleration of the apparatus.

54. The method as claimed in claim 41 comprising calculating a time required to rotate the load to a desired heading.

55. The method as claimed in claim 54 comprising calculating the time required to rotate the load to a desired heading based on a current heading angle, a desired heading angle, a current rotational speed of the apparatus and a rotational acceleration of the apparatus.

56. The method as claimed in claim 41 comprising monitoring a speed of rotation of the load.

57. The method as claimed in claim 56 wherein the speed of rotation of the load is monitored by a gyroscope, a compass or an accelerometer.

58. The method as claimed in claim 41 comprising the control unit generating a signal to circulate the fluid volume in the closed loop pipe in the opposing direction to the direction of rotation of the closed loop pipe to stop or reduce the speed of rotation of the closed loop pipe.

59. The method as claimed in claim 58 wherein the control unit calculates when to circulate the fluid volume in the closed loop pipe in the opposing direction based on the current heading position of the load, rotational speed of the load and the desired heading position.

60. The method as claimed in claim 41 comprising generating a flow of fluid volume in the closed loop pipe to control the circulation of a solid mass in the closed loop pipe.

61. The method as claimed in claim 60 comprising circulating the solid mass in the same plane and direction as the flow of fluid volume in the closed loop pipe.

62. A spreader bar comprising a closed loop pipe containing a fluid volume attachable to a suspended load;

at least one impeller for circulating the fluid volume in the closed loop pipe; and a control unit that receives at least one input direction signal;

wherein the control unit generates a control signal to activate the at least one impeller, wherein the at least one activated impeller controls the flow of the fluid volume in the closed loop pipe based on the at least one input direction signal to impart a rotational force on the closed loop pipe.

* * * * *